United States Patent [19]

Mattsson

[11] Patent Number: 4,789,123

[45] Date of Patent: Dec. 6, 1988

[54] TELESCOPIC STAY

[75] Inventor: Erik P. Mattsson, Vagnhärad, Sweden

[73] Assignee: G H Trading AB, Västerås, Sweden

[21] Appl. No.: 104,022

[22] Filed: Oct. 5, 1987

Related U.S. Application Data

[63] Continuation-in-part of Ser. No. 915,595, Oct. 6, 1986.

[51] Int. Cl.[4] ..... E05C 17/30

[52] U.S. Cl. ..... 248/240.4; 108/80; 108/82; 292/338

[58] Field of Search ..... 248/240, 240.3, 240.4, 248/351; 292/262, 278, 338; 108/80, 81, 82, 77

[56] References Cited

U.S. PATENT DOCUMENTS

| | | | |
|---|---|---|---|
| 1,228,042 | 5/1917 | O'Dowd | 248/240 |
| 2,154,125 | 4/1939 | Dillon | 108/81 |
| 2,284,003 | 5/1942 | Luppert | 108/81 |
| 2,352,837 | 7/1944 | Hillenbrand | 108/81 |
| 2,835,522 | 5/1958 | Serto | 108/82 |
| 4,068,601 | 1/1978 | Marsh | 248/240 |

FOREIGN PATENT DOCUMENTS

| | | | |
|---|---|---|---|
| 196398 | 5/1965 | Sweden | 292/262 |
| 1524281 | 9/1978 | United Kingdom | 292/278 |

*Primary Examiner*—J. Franklin Foss
*Assistant Examiner*—Robert A. Olson
*Attorney, Agent, or Firm*—Sughrue, Mion, Zinn, Macpeak and Seas

[57] ABSTRACT

A telescopic stay for two objects which can be folded relative to one another, particularly for supporting a work surface which can be folded in relation to a frame structure. The stay includes two tubes 6, 7 which can be telescoped one within the other and which are intended for pivotal connection at mutually opposite ends thereof to a respective one of said objects, and further includes an inner guide tube 8 arranged in the telescopic tubes, a tension spring 15 which extends axially through all tubes, and a locking means 9 for releasably locking the telescopic tubes in a given working position relative to one another. To facilitate mounting of the stay, the inner guide tube is fixed axially in relation to one telescopic tube and accompanies the movement of this tube in relation to the other telescopic tube. For the purpose of damping oscillations, between the foldable objects, when the stay is retracted, he ends of the tension spring are each fixed in relation to their respective telescopic tubes and the length of the tension spring is adapted so that the spring constantly strives to telescope the tubes together.

10 Claims, 4 Drawing Sheets

TELESCOPIC STAY

This is continuation-in-part of application Ser. No. 915,595, filed Oct. 6, 1986.

The present invention relates to a telescopic stay for supporting two objects which are capable of being folded relative to one another, and particularly, although not exclusively, for supporting a work surface which can be folded relative to a frame structure.

In the case of foldable work surfaces which are supported in their raised positions by means of some suitable form of stay, it is desirable that the stay will enable the work surface to be locked readily and reliably in its raised position, and to be readily released from said locked position prior to lowering the work surface. The stay must also be capable of locking the raised work surface reliably and to form a firm support for the work surface in the desired working position thereof.

A telescopic stay which fulfils these desiderata to a large extent is known from the British Patent Specification No. 1 524 281 and comprises two tubes which can be displaced telescopically in relation to one another and the mutually opposite ends of which are each pivotally connected to a respective one of said two objects, and further comprises an inner guide tube arranged within the telescopic tubes, a tension spring which extends axially through all tubes, and locking means for releasably locking the telescopic tubes in a given working position relative to one another.

This known stay, however, is encumbered, inter alia, with a number of disadvantages. When the telescopic tubes are retracted one within the other, the inner guide tube projects beyond the ends of the telescopic tubes, thereby preventing the stay from being fitted directly to a complete surface, e.g. a wall. Instead it is necessary to fit the stay to a surface which is laterally offset, so that the inner guide tube can be permitted to project out from the telescopic tube.

When stays of this particular kind are intended, inter alia, to support tables or work surfaces in watercraft, caravans and in other connections where relative movement of the aforesaid two objects can occur, it is essential that the stay is capable of preventing the work surface from swinging, or of damping such swinging movement, when the work surface occupies its collapsed or lowered position. Since, when the known stay is retracted, the aforesaid inner guide tube projects from the outer telescopic tube, the tension spring has no damping effect whatsoever on the swinging movement of the foldable work surface, unless the work surface swings to such an extent as to cause a stop provided on the inner guide tube to engage the outer telescopic tube. Consequently, small swinging movements are not damped at all.

The main object of the invention is to provide an improved stay of the aforedescribed kind in which, inter alia, the aforesaid drawbacks are no longer found. In order to enable the stay to be fitted directly to a wall or corresponding surface it is essential that the inner guide tube will not project from the telescopic tubes in any position of the tubes. Furthermore, the tension spring shall constantly draw the telescopic tubes together, so as to dampen the swinging motion of, for example, a work surface in its downwardly folded position.

Accordingly, a stay according to the invention is characterized in that the inner guide tube is fixed axially in relation to one of the telescopic tubes and accompanies the tube in its axial movement relative to the other of said tubes, and in that each end of the tension spring is fixed in relation to its respective telescopic tube, the length of the tension spring being such that the spring will constantly exert on the telescopic tubes a force which strives to draw said tubes together.

With a stay of this construction the inner guide tube will not protrude beyond the telescopic tubes, and the stay is effective for damping even small relative swinging movements between the mutually hinged objects to which the stay is fitted, the extent to which damping is achieved being dependent on the force exerted by the tension spring.

In order to permit different relative working positions between the two objects the outer surface of the outer one of the two telescopic tubes is preferably provided with circumferential shoulders adapted to cooperate with a pivotally mounted locking arm. To this end the outer telescopic tube is preferably made up of several coaxial tubes placed one within the other, each of which tubes protrudes from the immediate outer tube such that the end surface of each tube forms one engagement shoulder for the locking arm.

Preferably, the locking arm is pivotally mounted at one end of the arm which end may have the form of a sleeve which embraces the inner telescopic tube. A spring can therewith be mounted between the inner telescopic tube and the sleeve-shaped part of the arm to constantly bias the arm towards its locking position.

In a preferred embodiment of the stay, each of the outer ends of respective telescopic tubes is secured to a respective mounting means by means of a pivot having the form of a peg which extends diametrically through respective tubes. The inner guide tube can therewith be fixed axially in relation to the outer telescopic tube with the aid of the peg passing through said tube, and the pivotally mounted locking arm can be pivoted around the peg passing diametrically through the inner telescopic tube.

In order to facilitate fitting of the stay to the aforesaid objects, each of the said mounting means preferably includes a pair of angle pieces the respective one legs of which are located opposite one another on mutually different sides of respective telescopic tubes and are provided with holes for receiving an associated peg.

Simple and reliable mounting of the tension spring is achieved by securing one end of the spring to the peg passing through the inner telescopic tube and by hooking the other end of the spring firmly to the end of the inner guide tube connected to the other peg.

The invention will now be described in more detail with reference to the accompanying drawings.

Figures 1, 2:
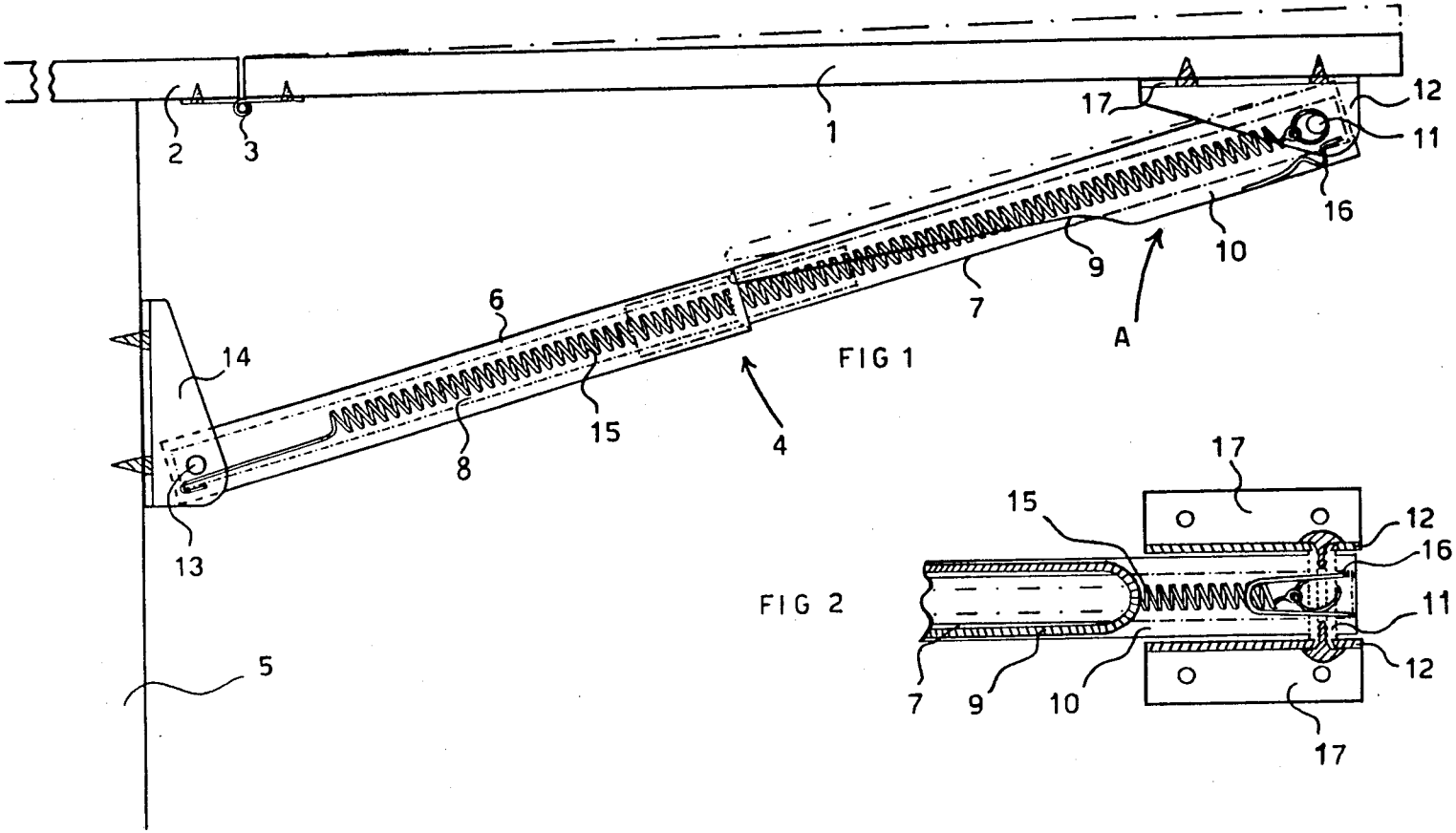
FIG. 1 illustrates a stay according to the invention in the supporting position of said stay.
FIG. 2 is a bottom plan view of part of the stay illustrated in FIG. 1.

In FIG. 1 the reference numeral 1 identifies a work surface which is hinged to a stationary or fixed surface 2 by means of a hinge 3. In order to hold the work surface 1 in a horizontal work position flush with the fixed surface 2, a stay 4 according to the invention is mounted between the work surface 1 and a support frame structure 5, which may consist, for example, of a table frame, a wall or some corresponding structure.

The stay 4 includes an outer telescopic tube 6 and an inner telescopic tube 7, which are arranged to slide axially one within the other. Arranged within the outer telescopic tube 6 is an inner reinforcing guide tube 8, which also extends into the inner telescopic tube 7. The reference numeral 9 identifies a locking arm, one end 10 of which is sleeve-shaped and embraces the inner tube 7, and the other end of which is cupped or half-cylindrical in shape and presents a bevelled end surface which in its locking position engages beneath a correspondingly bevelled end surface on the outer tube 6 for locking co-action therewith.

The inner telescopic tube 7 is pivotally connected to the work surface 1 by means of a pivot having the form of a hollow, tubular peg 11 which passes diametrically through the tube 7 and the sleeve-like end 10 of the locking arm 9, between two mutually opposing flanges 12 on a mounting arrangement which includes an angle piece located on each side of the sleeve-shaped end 10. The outer telescopic tube 6 is similarly pivotally mounted by means of a pivot in the form of a peg 13 which is fitted in two mutually opposing flanges 14 and extends diametrically through the tube 6 and the guide tube 8. The angle pieces with the flanges 12 are screwed to the undersurface of the work surface 1.

A tension spring 15, which for the sake of clarity has been shown in full lines, extends axially through all of the tubes and is attached at one end to the peg 11 and at the other end is firmly hooked over one end of the inner guide tube 8. In the active supporting state of the stay illustrated in FIG. 1, the spring 15 is extended and strives therefor to draw the two telescopic tubes 6 and 7 together. In the illustrated state of the stay, however, the tubes are prevented from being retracted one within the other by the locking arm 9, which is in locking engagement (full lines) with the outer telescopic tube 6. The locking arm is biased towards its locking position by means of a bias spring 16, which acts between the inner telescopic tube 7 and the sleeve-shaped part 10 of the locking arm.

Unintentional release of the locking arm 9 is also prevented through the engagement of the free, bevelled end of the locking arm with the undersurface of the correspondingly bevelled edge of the outer tube 6, this locking engagement being maintained in the illustrated position also through the weight of the work surface 1 acting on the arm.

FIG. 2 is a bottom plan view of the right-hand end of the stay 4 illustrated in FIG. 1 and the associated mounting means.

It will be seen from FIG. 2 that, among other things, the free end of the locking arm 9 has the form of a slotted tube or sleeve of the same diameter as the sleeve-shaped end 10. The end of the part 9 is also bevelled so that its outer surface coincides substantially with the outer surface of the outer tube 6 with which the locking arm is intended to cooperate. This means that engagement of the bevelled end surface of the locking arm 9 with the end surface of the telescopic tube 6 takes place over a relatively large peripheral arcuate surface, thereby avoiding the drawback of a punctiform contact between the mutually engaging surfaces and also the subsequent elevated wear thereon which would result from such contact.

In order to enable the locking arm 9 to swing freely, to some slight extent, to the position shown in chain lines in FIG. 1, the diameter of the sleeve-shaped part 10 of the arm must be greater than that of the telescopic tube 7, so as to provide sufficient space for such movement to take place.

The through-passing peg 11 is firmly riveted or swaged in holes provided in the outwardly projecting flanges 12 of the angle pieces 17, vide FIG. 2. The same applies to the tubular peg 13 at the other end of the stay. The open ends of the tubular pegs are closed with homogenous plastic plugs.

Figure 3:
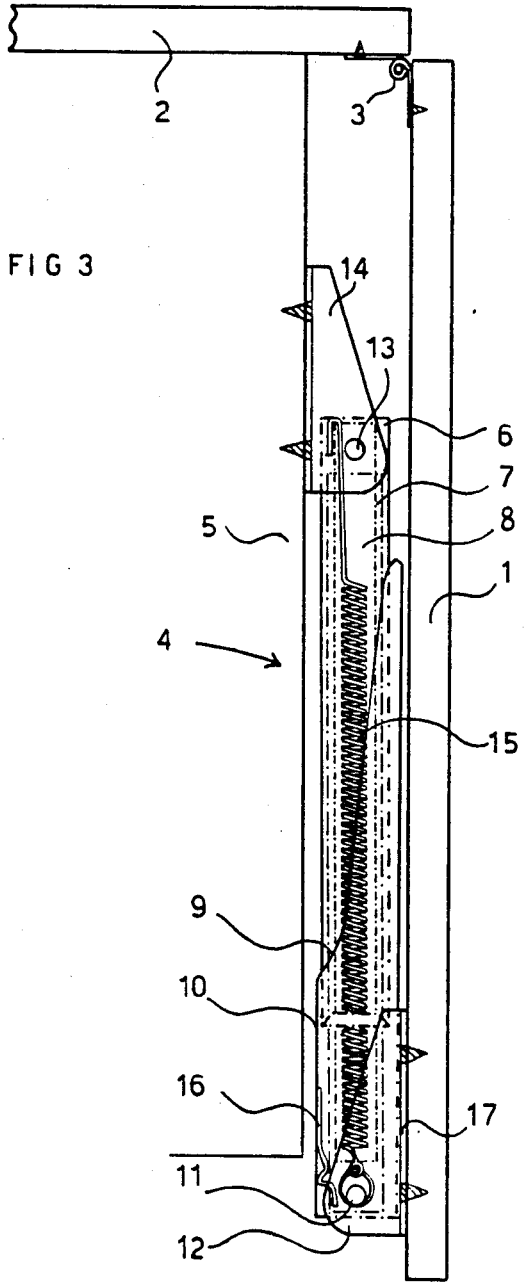
FIG. 3 illustrates the stay of FIG. 1 in its retracted state.

FIG. 3 illustrates the work surface 1 with the stay 4 in a retracted state. The length of the tension spring 15 is such that the spring is still slightly stretched when the work surface occupies its lowered position, so that the spring will exert a damping effect on undesired swinging movement of the downwardly folded work surface. The desired damping effect can be obtained with the aid of a spring of suitable spring rating.

It will be seen from FIGS. 2 and 3 that no parts project from the telescopic tubes 6 and 7 when collapsing the work surface 1, which facilitates fitting of the stay to the aforesaid two objects and allows the stay to be used in connections in which, in many cases, the previously known stays could not be used or could only be used with great difficulty. The aforedescribed stay operates in the following manner.

In the collapsed position of the work surface 1, illustrated in FIG. 3, the telescopic tubes 6 and 7 of the stay are withdrawn one inside the other. In this position of the stay the locking arm 9 is biased towards the outer surface of the telescopic tube 6 by means of the spring 16. As beforementioned, the tension spring 15 is also under some tension in this position of the stay.

When the work surface is swung upwardly on the hinge 3, the telescopic tube 7 will be progressively extended from the telescopic tube 6. When the position illustrated in chain lines in FIG. 1 is reached, the free end of the locking arm 9 will be urged by its own weight and the bias of the spring 16 downwardly in front of the end of the outer telescopic tube 6 and, upon return of the work surface 1 to the position illustrated in full lines, locking engagement is achieved between the bevelled end surfaces of the locking arm 9 and the tube 6.

In this position the load-absorbing stay 4 provides an extremely stable support for the work surface 1 in the absence of any risk of unintentional collapsing of the work surface, since three mutually different hand manipulations are required to collapse said surface. Thus, in order to lower the work surface it must first be lifted to the position shown in chain lines in FIG. 1, in order to free the locking arm 9 from the telescopic tube 6. Pressure must then be applied to the sleeve-shaped part 10 in the direction of the arrow A, in order to swing the locking arm 9 around the peg 11, against the action of the spring 16, to bring the arm to the position shown in chain lines in FIG. 1. The work surface 1 must then be again lowered to the position shown in full lines, while holding the locking arm in the aforesaid position, whereafter the locking arm can be released. When the locking arm is released it slides over and along the telescopic tube 6 while lowering the work surface 1 to the position illustrated in FIG. 3.

If a particular application so requires, the work surface may also be swung beyond the vertical position illustrated in FIG. 3, or may be stopped before said vertical position is reached.

Because of its stable construction and the positive locking action afforded thereby, the stay can be fitted so as to form only a very small angle with the work surface 1 in the working position illustrated in FIG. 1, this feature being beneficial since a large part of the space beneath the work surface is therewith made freely available.

In addition to foldable work surfaces 1, a stay constructed in accordance with the invention can be used with other types of flaps or pivotable parts irrespective of their orientation and pivotal directions. Because the two ends of the stay can be mounted with the aid of through-passing pegs, the stay can be fitted selectively to any desired object. The stay can also be mounted between two pivotable objects.

For certain applications it can be desirable to be able to lock two relatively each other pivotable objects in different relative positions, such as in case of writing desks, drawing tables, ventilation flaps, etc. To this end stay 4 can be modified as shown in FIGS. 4 and 5 in which like parts have the same reference numerals as in FIGS. 1–3.

Figure 4:
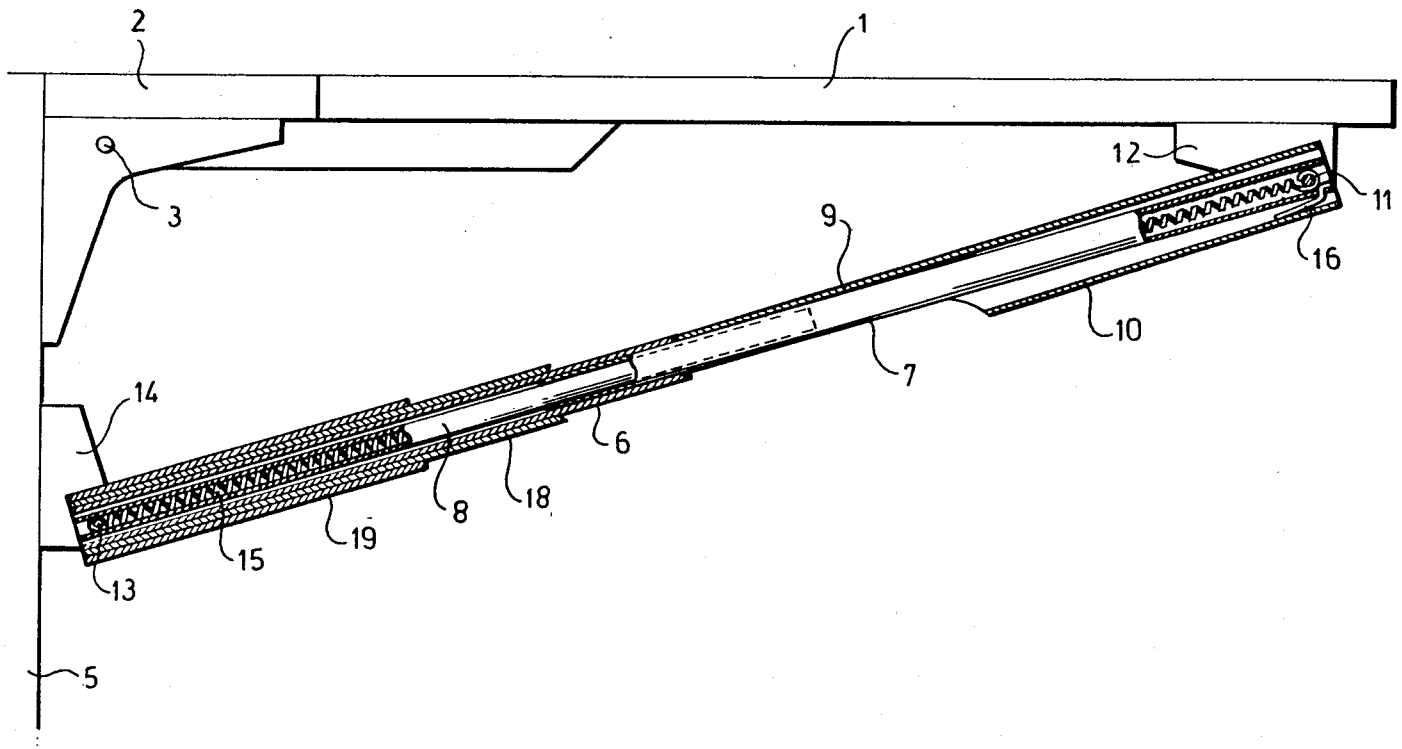
FIG. 4 illustrates a modified stay according to FIG. 1 designed to permit three different working positions.
Figure 5:
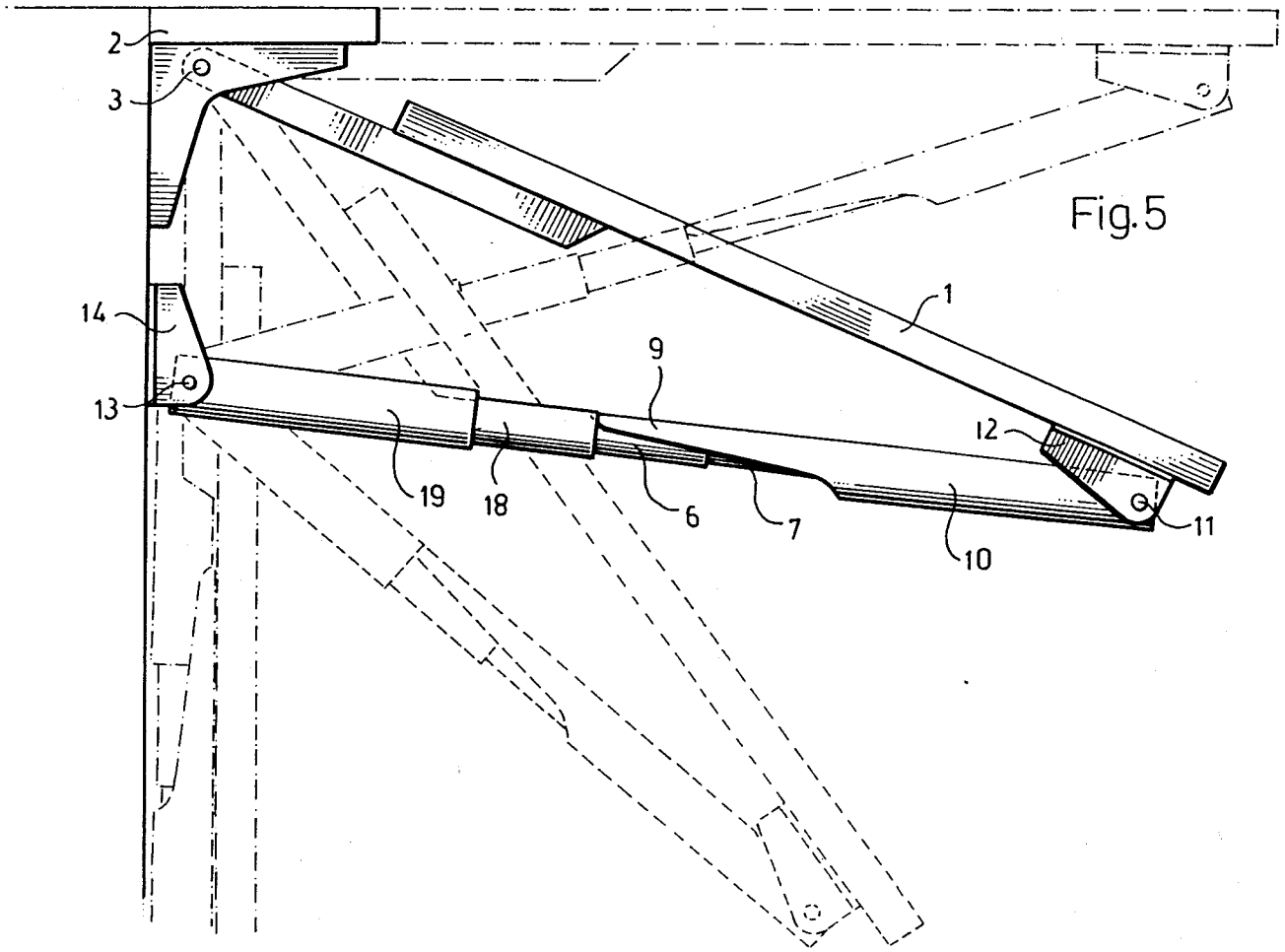
FIG. 5 illustrates the operation of the stay of FIG. 4.

The only difference between the modified stay and the above described stay is that in the stay of FIGS. 4 and 5 the outer telescopic tube 6 is surrounded by two additional shorter tubes 18 and 19, respectively. The end surface of each tube 6, 18 and 19 forms one engagement shoulder for the locking arm. Hereby the stay of FIGS. 4 and 5 can be used to lock the work surface 1 in any of three different positions relative to the other object 2, as illustrated in FIG. 5. To change the position of the work surface between the different positions the same manipulations have to be carried out as described above in connection with FIGS. 1–3.

Instead of using three different tubes 6, 18 and 19 several engagement shoulders can be provided on the outer surface of the tube 6 in any suitable manner.

The aforedescribed embodiments of a stay according to the invention are those at present preferred, although it will be understood by those skilled in this art that various modifications can be made within the scope of the following claims. This applies, for example, to the construction of the spring elements, the locking arm and the mounting means. Although the tubes shown have a circular cross section they can as well have a square or any other cross section.

I claim:

1. A telescopic stay for two objects capable of being folded relative to one another, particularly for supporting a work surface (1) which can be folded relative to a frame structure (5), the stay including at least two tubes (6,7) which are capable of being telescopically retracted one within the other and the mutually opposite free ends of which are intended to be pivotally connected to a respective one of said objects, and further including an inner guide tube (8) arranged within the telescopic tubes, a tension spring (15) extending axially through all tubes, and a locking means (9) for releasably locking the telescopic tubes in a given working position relative to one another, characterized in that the inner guide tube is fixedly mounted (13) to one of the telescopic tubes (6) such that relative axial movement between said one tube and the guide tube is prevented and the guide tube accompanies movement of said one telescopic tube in relation to the other telescopic tube (7) and remains fully within the telescopic tubes in all positions thereof; and in that opposite ends of the tension spring are individually fixedly attached to remote ends of the telescopic tubes, the unloaded length of the tension spring being less than the distance between said remote ends of the telescopic tubes when fully retracted one within the other such that the spring constantly exerts a force on the telescopic tubes which strives to further retract the tubes one inside the other in all positions to thus damp free swinging motions of the work surface in a folded, retracted position.

2. A stay according to claim 1, characterized in that an outer surface of an outer one (6) of the two telescopic tubes is provided with a plurality of axially spaced circumferential shoulders adapted to cooperate with a pivotally mounted locking arm which comprises said locking means.

3. A stay according to claim 2, characterized in that said outer telescopic tube is made up of several coaxial tubes (6,18,19) placed one within the other, each of which tubes protrudes from an immediate outer tube such that an end surface of each tube forms one engagement shoulder for the locking arm.

4. A stay according to claim 2 in which the locking arm is pivotally mounted at one end of the arm which end has the form of a sleeve (10) embracing an inner one (7) of the two telescopic tubes, characterized in that a spring (16) is mounted between the inner telescopic tube and the sleeve-shaped part of said arm to constantly bias said arm towards its locking position.

5. A stay according to claim 3 in which the locking arm is pivotally mounted at one end of the arm which end has the form of a sleeve (10) embracing an inner one (7) of the two telescopic tubes, characterized in that a spring (16) is mounted between the inner telescopic tube and the sleeve-shaped part of said arm to constantly bias said arm towards its locking position.

6. A stay according to claim 1, characterized in that the outer ends of the telescopic tubes are pivotally mounted to a respective mounting means by means of a pivot in the form of a peg (11, 13) which extends diametrically through respective tubes.

7. A stay according to claim 6, characterized in that the inner guide tube is fixed axially in relation to an outer one (6) of the two telescopic tubes with the aid of the peg (13) passing through said tube.

8. A stay according to claim 6, characterized in that a pivotally mounted locking arm which comprises the locking means can be swung around the peg (11) passing through an inner one (7) of the two telescopic tubes.

9. A stay according to claim 6, characterized in that each of said mounting means includes a pair of angle pieces the legs of which are located mutually opposite one another on different sides of associated telescopic tubes and are provided with holes for receiving respective pegs.

10. A stay according to claim 6, characterized in that one end of the tension spring is attached to the peg passing through the inner telescopic tube while the other end of the spring is hooked firmly to the end of the inner guide tube connected with the other peg.

* * * * *